US008918037B2

(12) United States Patent
Yotsutsuji

(10) Patent No.: US 8,918,037 B2
(45) Date of Patent: Dec. 23, 2014

(54) DEVELOPING DEVICE AND IMAGE FORMING APPARATUS

(71) Applicant: KYOCERA Document Solutions Inc., Osaka (JP)

(72) Inventor: Takefumi Yotsutsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/743,972

(22) Filed: Jan. 17, 2013

(65) Prior Publication Data

US 2013/0188996 A1 Jul. 25, 2013

(30) Foreign Application Priority Data

Jan. 19, 2012 (JP) ..... 2012-009394

(51) Int. Cl.
*G03G 15/08* (2006.01)

(52) U.S. Cl.
CPC ..... *G03G 15/081* (2013.01); *G03G 15/0812* (2013.01)
USPC ..... 399/284

(58) Field of Classification Search
CPC ..... G03G 15/09; G03G 15/0818; G03G 15/0808; G03G 15/0815; G03G 15/0812
USPC ..... 399/274, 279, 281, 282, 283, 284, 286
See application file for complete search history.

(56) References Cited

U.S. PATENT DOCUMENTS

| | | | | |
|---|---|---|---|---|
| 4,788,570 | A | 11/1988 | Ogata et al. | |
| 4,876,574 | A * | 10/1989 | Tajima et al. | 399/275 |
| 6,266,507 | B1 * | 7/2001 | Nagahama et al. | 399/274 |

FOREIGN PATENT DOCUMENTS

| | | | |
|---|---|---|---|
| JP | 61-238072 | A | 10/1986 |
| JP | 09-090744 | A | 4/1997 |
| JP | 2000-089561 | A | 3/2000 |
| JP | 2000-089651 | A | 3/2000 |
| JP | 2000-338776 | A | 12/2000 |
| JP | 2001-005270 | A | 1/2001 |

OTHER PUBLICATIONS

Notice of Reasons for Rejection issued to JP Application No. 2012-009394 mailed Jul. 2, 2013.
Notice of Reasons for Rejection issued to JP Application No. 2012-009394 mailed Dec. 3, 2013.

* cited by examiner

*Primary Examiner* — Hoang Ngo
(74) *Attorney, Agent, or Firm* — Arent Fox LLP

(57) ABSTRACT

This disclosure relates to a developing device supplying a non-magnetic one-component developer onto an image bearing member on which an electrostatic latent image is formed. The developing device has an accommodating portion, a supply roller, a development roller, and a regulating member. The accommodating portion accommodates the developer. The supply roller holds the developer accommodated in the accommodating portion on the outer circumferential surface thereof. The development roller has a roller portion, and a rotational shaft member. The roller portion receives the developer supplied from the supply roller and holds a developer layer on the outer circumferential surface thereof. The rotational shaft member is arranged to extend along a rotational axis and has at least one magnet portion. The regulating member is a plate member arranged to be surface contacted onto the surface of the developer layer on the development roller and having part thereof configured of a magnetic member.

8 Claims, 8 Drawing Sheets

FIG. 6

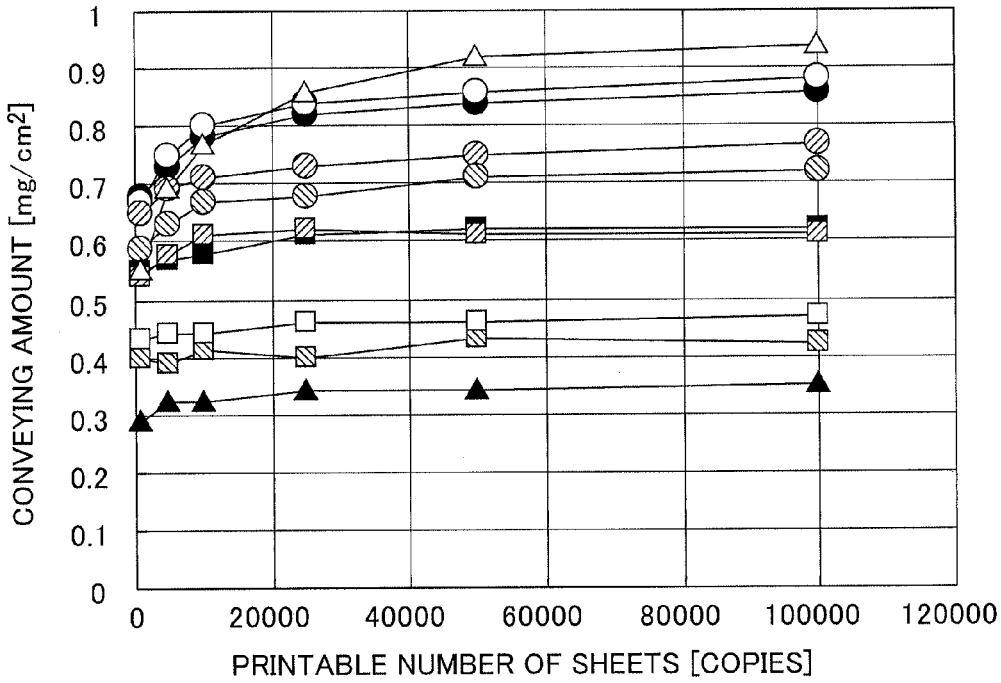

| | |
|---|---|
| ●— | MAGNETIC FORCE30 SATURATION MAGNETIZATION50 EXAMPLE1 |
| —○— | MAGNETIC FORCE30 SATURATION MAGNETIZATION100 EXAMPLE2 |
| —⊘— | MAGNETIC FORCE30 SATURATION MAGNETIZATION150 EXAMPLE3 |
| —⊘— | MAGNETIC FORCE60 SATURATION MAGNETIZATION50 EXAMPLE4 |
| —■— | MAGNETIC FORCE60 SATURATION MAGNETIZATION100 EXAMPLE5 |
| —□— | MAGNETIC FORCE60 SATURATION MAGNETIZATION150 EXAMPLE6 |
| —▨— | MAGNETIC FORCE90 SATURATION MAGNETIZATION50 EXAMPLE7 |
| —▧— | MAGNETIC FORCE90 SATURATION MAGNETIZATION100 EXAMPLE8 |
| —▲— | MAGNETIC FORCE90 SATURATION MAGNETIZATION150 EXAMPLE9 |
| —△— | Reference |

FIG. 8

| | m1: MAGNETIC FORCE [mT] | m2: SATURATION MAGNETIZATION [emu/g] | $m1 \times m2 / L^2$ | EVALUATION |
|---|---|---|---|---|
| EXAMPLE1 | 30 | 50 | 30.6 | × |
| EXAMPLE2 | 30 | 100 | 61.2 | × |
| EXAMPLE3 | 30 | 150 | 91.8 | × |
| EXAMPLE4 | 60 | 50 | 61.2 | × |
| EXAMPLE5 | 60 | 100 | 122.4 | ○ |
| EXAMPLE6 | 60 | 150 | 183.7 | ○ |
| EXAMPLE7 | 90 | 50 | 91.8 | ○ |
| EXAMPLE8 | 90 | 100 | 183.7 | ○ |
| EXAMPLE9 | 90 | 150 | 275.5 | × |

DEVELOPING DEVICE AND IMAGE FORMING APPARATUS

INCORPORATION BY REFERENCE

This application is based upon and claims the benefit of priority from the corresponding Japanese Patent Application No. 2012-009394, filed in the Japan Patent Office on Jan. 19, 2012, the entire contents of which are incorporated herein by reference.

BACKGROUND

This disclosure relates to a developing device and an image forming apparatus.

There is an image forming apparatus of a type adopting a non-magnetic one-component developing method.

In the image forming apparatus of this type, for the layer pressure regulation and charging of a toner layer formed on a development roller, a blade member is surface contacted onto the development roller at a predetermined regulation pressure. To realize stable image forming, the blade member is required to be abutted onto the toner layer at the predetermined regulation pressure.

For instance, an image forming apparatus is proposed which has a developing device in which a resilient regulating blade is abutted onto a development roller at a linear pressure of 0.1 to 0.6 kg/mm.

However, in the proposed image forming apparatus (developing device), when the resilient regulating blade becomes worn, the regulation pressure (linear pressure) is changed, with the result that the layer pressure cannot be maintained uniform.

SUMMARY

This disclosure relates to a developing device supplying a non-magnetic one-component developer onto an image bearing member on which an electrostatic latent image is formed. The developing device has an accommodating portion, a supply roller, a development roller, and a regulating member. The accommodating portion accommodates the developer. The supply roller holds the developer accommodated in the accommodating portion on the outer circumferential surface thereof. The development roller has a roller portion, and a rotational shaft member. The roller portion receives the developer supplied from the supply roller, and holds a developer layer on the outer circumferential surface thereof. The rotational shaft member is arranged to extend along a rotational axis, and has at least one magnet portion. The regulating member is a plate member arranged to be surface contacted onto the surface of the developer layer on the development roller and having at least part thereof configured of a magnetic member.

In addition, this disclosure relates to an image forming apparatus having an image bearing member on which an electrostatic latent image is formed, and the developing device.

BRIEF DESCRIPTION OF DRAWINGS

FIG. 6 is a graph showing a change in conveying amount (developer layer thickness) with respect to the printable number of sheets;

FIG. 8 is a table showing the evaluation results of Examples.

DETAILED DESCRIPTION

Hereinafter, an embodiment of this disclosure will be described with reference to the drawings.

Figure 1:
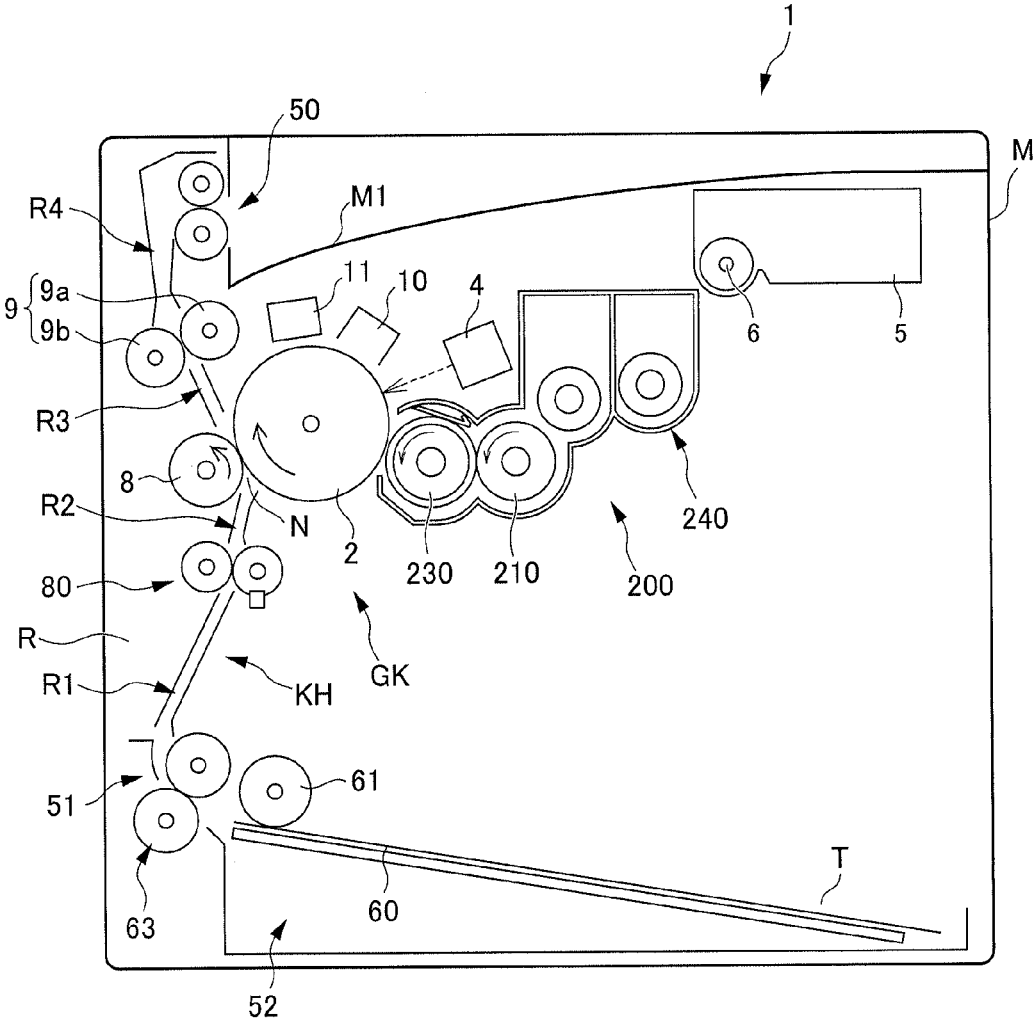
FIG. 1 is a left side view of assistance in explaining the arrangement of the components of a printer 1 of this embodiment.

Referring to FIG. 1, the entire configuration of a printer 1 as an image forming apparatus will be described. A developing device of this disclosure is included in the printer 1. FIG. 1 is a left side view of assistance in explaining the arrangement of the components of the printer 1 of this embodiment. In this embodiment, the side in the direction in which a sheet T is discharged from a later-described sheet discharging portion 50 (the right side in FIG. 1) is the front side of the printer 1.

The printer 1 of this embodiment has an image forming portion GK forming a predetermined image on the sheet T based on predetermined image information, and a sheet feeding and discharging portion KH feeding the sheet T to the image forming portion GK and discharging the sheet T on which the image is formed.

As shown in FIG. 1, the image forming portion GK has a photosensitive drum 2 as an image bearing member, a charging portion 10, a laser scanner unit 4, a developing device 200, a toner cartridge 5, a toner supplying device 6, a transfer roller 8 configuring part of a transferring portion, a fixing device 9 as a fixing portion, and a drum cleaning device 11.

The sheet feeding and discharging portion KH has a sheet cassette 52, a pair of registration rollers 80, a conveying path R of the sheet T, and the sheet discharging portion 50.

The photosensitive drum 2 includes a cylindrical member, and functions as the image bearing member. The photosensitive drum 2 is arranged in an apparatus body M to be rotatable about a rotational axis perpendicular to the sheet in FIG. 1. An electrostatic latent image is formed on the surface of the photosensitive drum 2. The photosensitive drum 2 is rotatable about a rotational axis C1.

The charging portion 10 is arranged above the photosensitive drum 2. The charging portion 10 uniformly negatively charges the surface of the photosensitive drum 2.

The laser scanner unit 4 is arranged above the photosensitive drum 2 to be spaced therefrom. The laser scanner unit 4 has a laser light source, a polygon mirror, a motor for driving the polygon mirror, which are not shown.

The laser scanner unit 4 exposes the surface of the photosensitive drum 2 with scanning based on image information outputted from an external device such as a PC (personal computer). By the exposure of the laser scanner unit 4 with scanning, the electric charges charged on the surface of the photosensitive drum 2 are removed. Thereby, the electrostatic latent image is formed on the surface of the photosensitive drum 2.

The developing device 200 is arranged to be opposite to the photosensitive drum 2. The developing device 200 develops a toner image in a single color (typically, black) on the electrostatic latent image formed on the photosensitive drum 2. The developing device 200 will be described later in detail.

The toner cartridge 5 accommodates toner supplied to the developing device 200.

The toner supplying device 6 supplies the toner accommodated in the toner cartridge 5 to the developing device 200.

The drum cleaning device 11 is arranged behind the photosensitive drum 2 (on the left side in FIG. 1). The drum cleaning device 11 removes the toner and/or adherent substances remaining on the surface of the photosensitive drum 2.

The transfer roller 8 transfers the toner image developed on the surface of the photosensitive drum 2 onto the sheet T. A transfer bias for transferring the toner image developed on the photosensitive drum 2 onto the sheet T is applied onto the transfer roller 8 by voltage applying means, not shown.

The transfer roller 8 is abutted onto or spaced from the photosensitive drum 2. Specifically, the transfer roller 8 is movable between an abutted position in which it is abutted onto the photosensitive drum 2 and a spaced position in which it is spaced from the photosensitive drum 2. In detail, when the toner image developed on the photosensitive drum 2 is transferred onto the sheet T, the transfer roller 8 is moved to the abutted position. Otherwise, the transfer roller 8 is moved to the spaced position.

The sheet T is nipped between the photosensitive drum 2 and the transfer roller 8, and is pressed onto the surface of the photosensitive drum 2 (the region in which the toner image is developed). A transfer nip N is formed in this way, so that the toner image developed on the photosensitive drum 2 is transferred onto the sheet T.

The fixing device 9 melts the toner configuring the toner image transferred onto the sheet T, and fixes it onto the sheet T. The fixing device 9 has a heating roller 9*a* heated by a heater, and a pressing roller 9*b* pressed onto the heating roller 9*a*. The heating roller 9*a* and the pressing roller 9*b* nip and convey the sheet T onto which the toner image is transferred. The sheet T is nipped between the heating roller 9*a* and the pressing roller 9*b* and conveyed, so that the toner transferred onto the sheet T is melted and fixed.

The sheet cassette 52 is arranged in the lower portion of the apparatus body M. The sheet cassette 52 is drawable horizontally toward the front side of the apparatus body M (on the right side in FIG. 1). The sheet cassette 52 has a placing plate 60 on which the sheet T is placed. The sheet T is stacked on the placing plate 60, and is accommodated in the sheet cassette 52. A cassette sheet-feeding portion 51 is arranged at the sheet feeding side end of the sheet cassette 52 (the left end in FIG. 1). The cassette sheet-feeding portion 51 feeds the sheet T accommodated in the sheet cassette 52 to the conveying path R (R1 to R4).

The cassette sheet-feeding portion 51 has a multi-feed prevention mechanism including a forward feeding roller 61 taking out the sheet T placed on the placing plate 60, and a pair of rollers 63 feeding each sheet T to the conveying path R.

The conveying path R conveying the sheet T is provided between the cassette sheet-feeding portion 51 and the sheet discharging portion 50. The conveying path R has a first conveying path R1 from the cassette sheet-feeding portion 51 to the pair of registration rollers 80, a second conveying path R2 from the pair of registration rollers 80 to the transfer roller 8, a third conveying path R3 from the transfer roller 8 to the fixing device 9, and a fourth conveying path R4 from the fixing device 9 to the sheet discharging portion 50.

The first conveying path R1, the second conveying path R2, the third conveying path R3, and the fourth conveying path R4 all extend substantially upward from the lower side.

The pair of registration rollers 80 are arranged on the upstream side in the conveying direction of the sheet T on the transfer roller 8 (the lower side in FIG. 1). The leading edge of the sheet T fed from the pair of rollers 63 is abutted once onto the pair of registration rollers 80 which are stopped. Then, the pair of registration rollers 80 are rotationally driven to feed the sheet T to the downstream side in the conveying direction. The pair of registration rollers 80 perform skew (skew feeding) correction of the sheet T, and timing adjustment between the sheet T and the toner image.

The sheet discharging portion 50 is provided at the end of the fourth conveying path R4. The sheet discharging portion 50 is arranged in the upper portion of the apparatus body M. The sheet discharging portion 50 is opened toward the front of the apparatus body M (the right side in FIG. 1). The sheet discharging portion 50 discharges the sheet T onto which the toner is fixed by the fixing device 9, to the outside of the apparatus body M.

A discharged-sheet stacking portion M1 is provided on the opening side of the sheet discharging portion 50. The discharged-sheet stacking portion M1 is formed on the upper surface (outer surface) of the apparatus body M. The discharged-sheet stacking portion M1 is the portion in which the upper surface of the apparatus body M is recessed downward. The bottom surface of the discharged-sheet stacking portion M1 configures part of the upper surface of the apparatus body M. The sheet T onto which the predetermined image is transferred and discharged from the sheet discharging portion 50 is stacked on the discharged-sheet stacking portion M1.

Next, the developing device 200 will be described in detail with reference to FIGS. 1 to 5.

Figure 2:
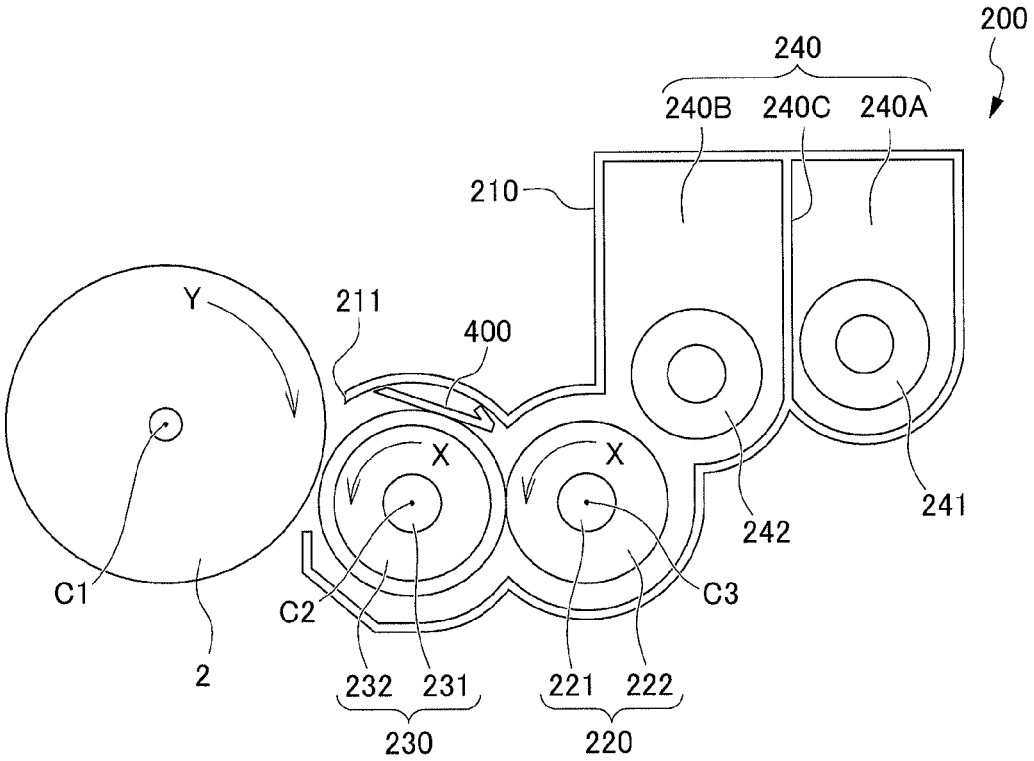
FIG. 2 is an enlarged sectional view showing the schematic configuration of a developing device 200 of this embodiment.
Figure 3:
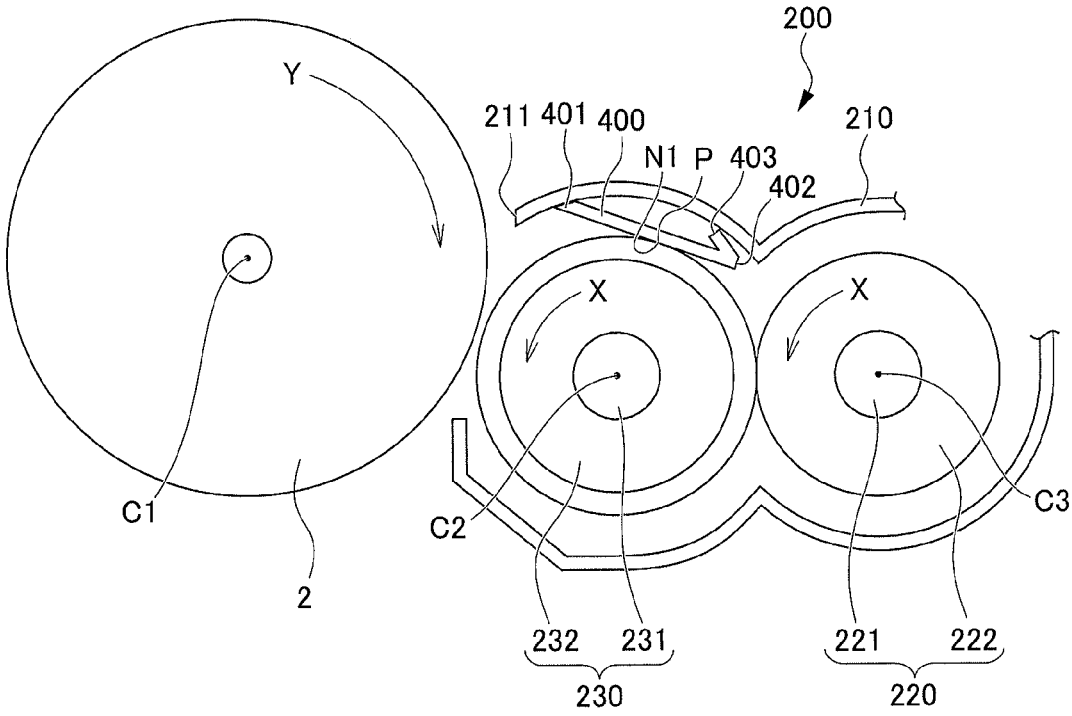
FIG. 3 is a partially enlarged sectional view of the developing device 200.
Figure 4:
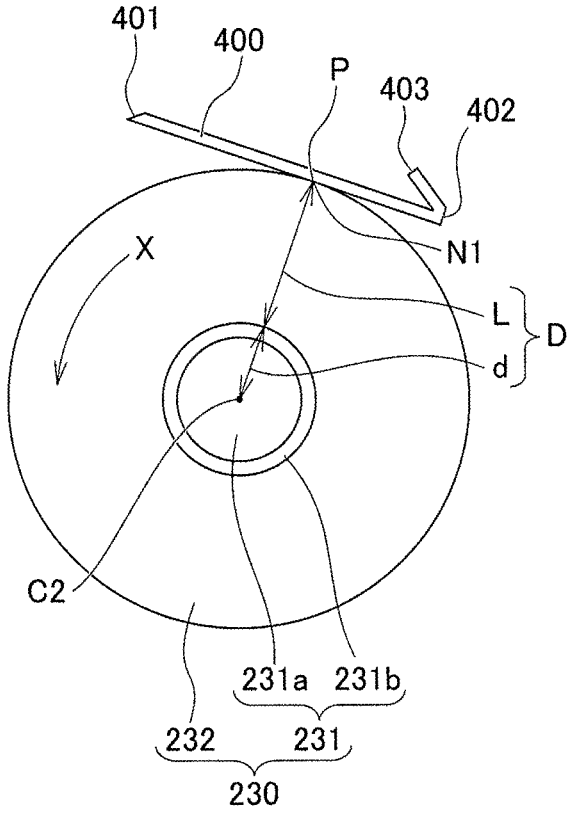
FIG. 4 is an enlarged sectional view of assistance in explaining the position relation between a development roller 230 and a regulating member 400 in the developing device 200.
Figure 5:
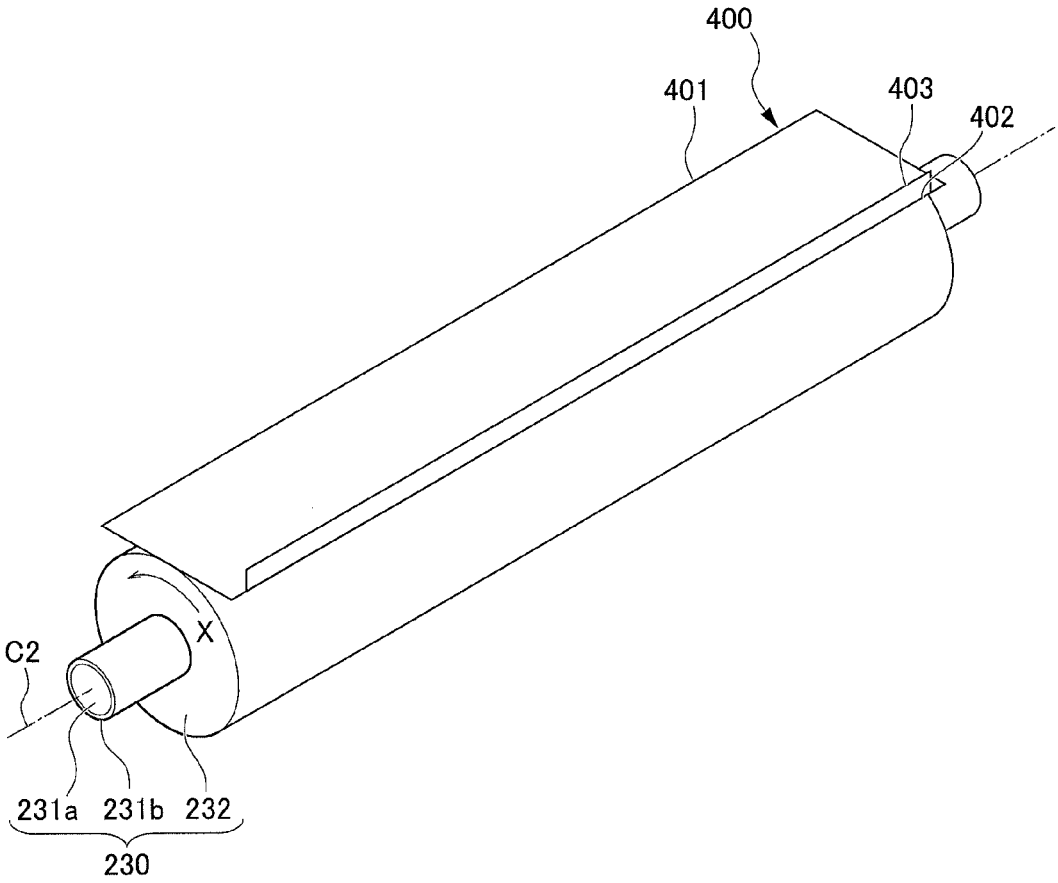
FIG. 5 is a perspective view showing the assembled state of the development roller 230 and the regulating member 400 in the developing device 200.

FIG. 2 is an enlarged sectional view showing the schematic configuration of the developing device 200 of the embodiment. FIG. 3 is a partially enlarged sectional view of the developing device 200. FIG. 4 is an enlarged sectional view of assistance in explaining the position relation between a development roller 230 and a regulating member 400 in the developing device 200. FIG. 5 is a perspective view showing the assembled state of the development roller 230 and the regulating member 400 in the developing device 200.

The developing device 200 is arranged to be opposite to the photosensitive drum 2. In the printer 1 shown in FIG. 1, the developing device 200 is arranged in a predetermined position on the front side of the photosensitive drum 2 of the apparatus body M (the right side in FIG. 1).

In this embodiment, the developing device 200 supplies a non-magnetic one-component developer onto the photosensitive drum 2. The developing device 200 holds the toner charged on the development roller 230. The developing device 200 supplies the charged toner onto the surface of the photosensitive drum 2, and develops the electrostatic latent image formed on the surface of the photosensitive drum 2.

As shown in FIGS. 2 and 3, the developing device 200 has an accommodating frame 210, a supply roller 220, the development roller 230, and the regulating member 400. The length in the axial direction of the supply roller 220 and the development roller 230 (in the direction perpendicular to the sheet in FIG. 2) is substantially the same as the length of the photosensitive drum 2.

The accommodating frame 210 accommodates therein the developer, the supply roller 220, the development roller 230, and the regulating member 400. The accommodating frame 210 has a predetermined-shaped internal space accommodating the respective members.

The accommodating frame 210 has an opening 211 arranged to be opposite to the photosensitive drum 2. The opening 211 exposes part of the later-described development roller 230 to the outside.

The accommodating frame 210 has a stirring chamber 240 (accommodating portion) accommodating the stirred developer.

The stirring chamber 240 accommodates the developer. As described above, the stirring chamber 240 accommodates the stirred non-magnetic one-component developer.

The stirring chamber 240 has a stirring mixer chamber 240A, and a paddle mixer chamber 240B. The stirring mixer chamber 240A and the paddle mixer chamber 240B are partitioned by a partitioning plate 240C.

A stirring mixer 241 is arranged in the stirring mixer chamber 240A. The stirring mixer 241 stirs the developer supplied into the stirring mixer chamber 240A by the toner supplying device 6.

A paddle mixer 242 is arranged in the paddle mixer chamber 240B. The paddle mixer 242 stirs the developer accommodated in the paddle mixer chamber 240B, and supplies the stirred developer onto the supply roller 220. In the stirring chamber 240, the non-magnetic one-component developer is stirred and charged.

As shown in FIGS. 2 and 3, the supply roller 220 is arranged below the stirring chamber 240 (diagonally left down in FIG. 2). The supply roller 220 is arranged to be opposite to the development roller 230. The supply roller 220 holds the developer accommodated in the stirring chamber 240 on the outer circumferential surface thereof. The supply roller 220 supplies the developer held on the outer circumferential surface thereof, onto the development roller 230.

The supply roller 220 has a shaft member 221, and a roller portion 222.

The shaft member 221 extends in the direction of a rotational axis C3 (see FIGS. 2 and 3). The shaft member 221 is rotationally supported by the shaft supporting portion (not shown) of the accommodating frame 210.

The roller portion 222 is cylindrical, and is attached to the outside of the shaft member 221. The roller portion 222 is made mainly of e.g., a non-magnetic metal material.

The roller portion 222 is rotated integrally with the shaft member 221 with the rotation thereof.

The roller portion 222 holds the developer accommodated in the stirring chamber 240 on the outer circumferential surface thereof. The roller portion 222 supplies the developer held on the outer circumferential surface thereof, onto the development roller 230.

As shown in FIGS. 2 and 3, the development roller 230 is arranged to be opposite to the photosensitive drum 2. The development roller 230 is arranged to be opposite to the photosensitive drum 2 via the opening 211.

The development roller 230 is arranged to be opposite to the supply roller 220.

The development roller 230 receives the developer supplied from the supply roller 220, and holds a developer layer on the outer circumferential surface thereof. The development roller 230 supplies the developer onto the photosensitive drum 2.

The development roller 230 has a shaft member 231 (rotational shaft member), and a roller portion 232.

The shaft member 231 extends along a rotational axis C2 (see FIGS. 2, 3, and 4).

The shaft member 231 is rotationally supported by the shaft supporting portion (not shown) of the accommodating frame 210.

The shaft member 231 has a core portion 231*a*, and a magnet portion 231*b*.

The core portion 231*a* is arranged on the center side of the shaft member 231, and supports the magnet portion 231*b*.

The magnet portion 231*b* has a magnetic pole arranged on the outer surface side of the shaft member 231. The shaft member 231 has at least one magnet portion. In this embodiment, the shaft member 231 has one magnet portion 231*b*.

The magnet portion 231*b* magnetically biases the later-described regulating member 400 toward the shaft member 231 (the roller portion 232) by a predetermined biasing force. The biasing force is set according to the magnetic force (m1) of the magnet portion 231*b*, the saturation magnetization (m2) of the material configuring the later-described regulating member 400, and the distance (L) between the magnet portion 231*b* and the regulating member 400. The biasing force is expressed by K (constant)×(m1×m2)/$L^2$.

The roller portion 232 is cylindrical, and is attached to the outside of the shaft member 231. The roller portion 232 is rotated integrally with the shaft member 231 with the rotation thereof.

The developer layer having a predetermined thickness is formed on the surface of the roller portion 232. The layer thickness of the developer layer is regulated (or uniformly adjusted to the predetermined thickness) by the later-described regulating member 400. The developer layer (developer) is charged by static electricity caused by the abutment onto the regulating member 400. In this embodiment, the developer layer is abutted onto the regulating member 400 at a constant regulation pressure, and is adjusted to the uniform thickness.

The roller portion 232 receives the developer supplied from the supply roller 220 (the roller portion 222), and holds the developer layer on the outer circumferential surface thereof. The roller portion 232 (the development roller 230) supplies the developer onto the photosensitive drum 2.

Preferably, a bias voltage is applied to between the development roller 230 and the supply roller 220 to efficiently move the non-magnetic one-component developer.

The regulating member 400 is a plate member, and has at least part thereof configured of a magnetic member. The regulating member 400 is a flat metal plate member having magnetic properties.

In the regulating member 400, one edge 401 is fixed to the accommodating frame 210, and the other edge 402 is a free edge.

In the other edge 402 (free edge) of the regulating member 400, the vicinity of the edge of the plate member configuring the regulating member 400 is folded to the opposite side of the development roller 230.

The regulating member 400 is arranged to be surface contacted onto the surface of the developer layer on the development roller 230. The regulating member 400 is surface contacted onto the developer layer formed on the surface of the development roller 230, so that the layer thickness of the developer layer is made uniform. The regulating member 400 also charges the developer layer (developer). The regulating member 400 forms a regulation nip N1 together with the development roller 230. The regulating member 400 forms the regulation nip N1 together with the development roller 230 in a predetermined position P.

The regulating member 400 has flexibility.

In the regulating member 400, the other edge 402 is flexible so as to be close to the development roller 230. In the regulating member 400, the other edge 402 (free edge) is biased in the direction toward the development roller 230 by the biasing force caused by the magnetic force of the magnet portion 231*b*. Thereby, the regulating member 400 is abutted onto the surface of the developer at the predetermined regulation pressure.

In the regulating member 400, the other edge 402 is flexible so as to move to be spaced from the development roller 230. Thereby, the regulating member 400 can smoothly guide the developer supplied from the supply roller 220 to the development roller 230 to a later-described regulation nip N1.

The regulating member 400 is biased to the development roller 230 by the biasing force having a predetermined strength caused by the magnetic force of the magnet portion 231*b* of the shaft member 231 configuring the development roller 230.

By the biasing force, the regulating member 400 is surface contacted (abutted) onto the surface of the developer layer at the regulation pressure having a predetermined strength. By the biasing force, the regulating member 400 is surface contacted onto the surface of the developer layer formed on the outer circumferential surface of the development roller 230 at the regulation pressure having a predetermined strength in the predetermined position P (regulation nip N1) on the other edge 402.

As described above, the biasing force applied to the predetermined position P on the regulating member 400 is set according to the magnetic force (m1) [mT] of the magnet portion 231*b*, the saturation magnetization (m2) [emu/g] of the material configuring the later-described regulating member 400, and the distance (L) [mm] between the magnet portion 231*b* and the regulating member 400. The biasing force is expressed by K (constant)×(m1×m2)/$L^2$.

In order to maintain the layer thickness of the developer layer in a preferable range, the regulation pressure is required to be set in a predetermined range. That is, the biasing force is required to be set in the predetermined range.

K is a constant. Therefore, when a numerical value calculated by (m1×m2)/$L^2$ is a biasing index, it is preferable to set the magnetic force (m1) [mT] of the magnet portion 231*b*, the saturation magnetization (m2) [emu/g] of the material configuring the regulating member 400, and the distance (L) [mm] between the magnet portion 231*b* and the regulating member 400 so that the biasing index is in the predetermined range.

In this embodiment, the biasing index is preferably 90 to 200, particularly preferably 90 to 185.

The magnetic force (m1) of the magnet portion 231*b* is set according to the biasing index. Particularly preferably, the magnetic force (m1) of the magnet portion 231*b* is 60 [mT] or more.

The regulating member 400 is biased to the development roller 230 at all times by the biasing force by the magnetic force of the magnet portion 231*b*. Therefore, even when the regulating member 400 becomes worn by the contact onto the development roller 230 (developer layer), it maintains the surface contact onto the developer layer at the constant regulation pressure.

Even when the regulating member 400 becomes worn, it is biased to the development roller 230 by the biasing force. Therefore, the distance between the regulating member 400 and the magnet portion 231*b* is not changed, and the regulating member 400 receives the biasing force having the same strength. That is, the regulation pressure of the regulating member 400 to the developer layer (development roller 230) maintains the constant strength even when the regulating member 400 becomes worn due to long use.

Even when the regulating member 400 becomes worn due to long use, it can maintain the layer thickness of the developer layer passing through the regulation nip N1 constant, and can uniformly charge the developer layer (developer).

Subsequently, the operation of the developing device 200 will be described.

First, the developing device 200 starts operation by an instruction from an image forming controlling portion (not shown). Specifically, in the developing device 200, the supply roller 220, the development roller 230, the stirring mixer 241, and the paddle mixer 242 are rotationally driven in the direction indicated by an arrow X at a predetermined speed, respectively, by a driving force transmitted from a predetermined driving motor (not shown). The photosensitive drum 2 is rotationally driven in the direction indicated by an arrow Y.

Thereby, the stirring mixer 241 and the paddle mixer 242 stir the one-component developer accommodated in the stirring chamber 240. The developer is stirred by the stirring mixer 241 and the paddle mixer 242, and is circulated and charged in the stirring chamber 240. The paddle mixer 242 supplies the developer accommodated in the stirring chamber 240 onto the supply roller 220.

The supply roller 220 supplies the developer supplied from the stirring chamber 240 onto the development roller 230.

The development roller 230 holds the developer supplied from the supply roller 220 on the outer circumferential surface thereof. Specifically, the development roller 230 conveys the developer supplied from the supply roller 220 and held on the outer circumferential surface of the roller portion 232 to the regulation nip N1.

Thereby, the developer held on the development roller 230 has the layer pressure regulated in the regulation nip N1 by the regulating member 400, and is charged.

As described above, the regulating member 400 is surface contacted onto the surface of the developer layer formed on the outer circumferential surface of the development roller 230 to regulate (adjust) the layer thickness of the developer layer, and charges the developer layer (developer).

The distance between the regulating member 400 and the outer circumferential surface of the development roller 230 (roller portion 232) is increased toward the other edge 402 (free edge). Thereby, the developer conveyed to the regulation nip N1 is smoothly guided thereto. Further, in the regulating member 400, the other edge 402 (free edge) is flexible so as to move to the opposite side of the development roller 230. Therefore, even when the developer is conveyed much, the regulating member 400 smoothly guides the developer to the regulation nip N1.

The regulating member 400 is biased to the shaft member 231 by the magnetic force of the magnet portion 231*b* of the shaft member 231. Thereby, by the biasing force, the regulating member 400 is surface contacted onto the surface of the toner layer on the outer circumferential surface of the development roller 230 (roller portion 232) at the regulation pressure having a predetermined strength in the predetermined position P (regulation nip N1) on the other edge 402 (free edge).

When the developing device 200 (printer 1) is operated for a long time, the region on the predetermined position P in the regulating member 400 can become worn.

In the developing device 200, even when the regulating member 400 becomes worn, the distance between the regulating member 400 and the magnet portion 231*b* is not changed. Therefore, by the biasing force having a constant strength, the regulating member 400 is surface contacted (abutted) onto the surface of the developer layer at the regulation pressure having a constant strength.

Thereby, even when the developing device 200 is operated for a long time, it maintains the layer pressure of the developer layer formed on the outer circumferential surface of the development roller 230 constant and uniformly charges the developer layer.

Then, the development roller 230 supplies the developer onto the photosensitive drum 2. The development roller 230 develops the electrostatic latent image by the developer held on the outer circumferential surface thereof.

According to the developing device 200 of the printer 1 of this embodiment, for instance, the following effects are exhibited.

The developing device 200 of this embodiment supplies the non-magnetic one-component developer onto the photosensitive drum 2 on which the electrostatic latent image is formed.

The developing device 200 has the accommodating frame 210 (stirring chamber 240), the supply roller 220, the development roller 230, and the regulating member 400. The accommodating frame 210 (stirring chamber 240) accommodates the developer. The supply roller 220 holds the developer accommodated in the accommodating frame 210 (stirring chamber 240) on the outer circumferential surface thereof. The development roller 230 has the roller portion 232 receiving the developer supplied from the supply roller 220 and holding the developer layer on the outer circumferential surface thereof, and the shaft member 231 arranged to extend along the rotational axis C2 and having one (or more) magnet portion(s) 231*b*. The regulating member 400 is a plate member arranged to be surface contacted onto the surface of the developer layer on the development roller 230 and having at least part thereof configured of a magnetic member.

Thereby, the developing device 200 can surface contact the regulating member 400 onto the developer layer formed on the outer circumferential surface of the development roller 230 at the constant regulation pressure. The developing device 200 maintains the layer thickness of the developer layer formed on the surface of the development roller 230 constant, and uniformly charges the developer layer (developer).

The developing device 200 only has the regulating member 400 configured of a magnetic member, and the magnet portion 231*b* (e.g., permanent magnet) arranged in the shaft member 231 of the development roller 230. That is, without using any special components and devices, the developing device 200 maintains the layer thickness of the developer layer formed on the surface of the development roller 230 constant, and uniformly charges the developer layer (developer). Thereby, the developing device 200 exhibits the above operation and effects by a simple configuration. The developing device 200 can reduce the manufacturing cost.

In the developing device 200, even when the regulating member 400 becomes worn, the distance between the regulating member 400 and the magnet portion 231*b* is not changed. By the biasing force having a constant strength, the regulating member 400 is surface contacted (abutted) onto the surface of the developer layer at the regulation pressure having the constant strength. Thereby, even when the developing device 200 is operated for a long time, it maintains the layer pressure of the developer layer formed on the outer circumferential surface of the development roller 230 constant and uniformly charges the developer layer.

In the developing device 200, the regulating member 400 is a metal plate member. Thereby, in the developing device 200, its configuration can be simplified, and the manufacturing cost can be reduced.

Since the regulating member 400 is a metal plate member, it is likely to become worn, not to be partially damaged, when it is operated for a long time. Thereby, the regulating member 400 can continue uniform surface contact onto the surface of the developer layer. Even when the developing device 200 is operated for a long time, it maintains the layer pressure of the developer layer formed on the outer circumferential surface of the development roller 230 constant and uniformly charges the developer layer.

In the developing device 200, the one edge 401 of the regulating member 400 is fixed, and the other edge 402 is a free edge. The regulating member 400 is surface contacted onto the developer layer in the predetermined position P on the other edge 402 (free edge).

Thereby, the developing device 200 can easily adjust the regulation pressure with respect to the developer layer of the regulating member 400. In the developing device 200, the followability with respect to a change in the biasing force of the regulating member 400 is good.

In the developing device 200, the other edge 402 (free edge) of the regulating member 400 is flexible so as to move to the side spaced from the development roller 230.

Thereby, the developing device 200 smoothly guides the developer conveyed by the development roller 230 to the regulation nip N1. The developing device 200 can also preferably correspond to the change in the amount of the developer conveyed. In the developing device 200, the other edge 402 of the regulating member 400 is flexed corresponding to the conveying amount of the toner. Thereby, the developer can be smoothly guided to the regulation nip N1 without causing the developer to remain.

In the developing device 200, an end 403 of the other edge 402 of the regulating member 400 is folded to the opposite side of the development roller 230. Thereby, the developing device 200 improves the strength of the other edge 402 (free edge) of the regulating member 400. In addition, the developing device 200 cannot lower the guiding efficiency of the developer to the regulation nip N1.

In the developing device 200, the magnetic force (m1) of the magnet portion 231*b*, the saturation magnetization (m2) of the regulating member 400, and the distance (L) between the magnet portion 231*b* and the regulating member 400 are set so that the biasing index calculated by $(m1 \times m2)/L^2$ is 90 to 200. Thereby, the developing device 200 maintains the layer pressure of the developer layer formed on the outer circumferential surface of the development roller 230 constant, and uniformly charges the developer layer.

In the developing device 200, particular preferably, the magnetic force (m1) of the magnet portion 231*b* is 60 [mT] or more. In this case, more stably, the developing device 200 maintains the layer pressure of the developer layer formed on the outer circumferential surface of the development roller 230 constant, and uniformly charges the developer layer.

The printer 1 (image forming apparatus) having the developing device 200 exhibits the effects in the developing device 200 in the same manner.

EXAMPLES

Here, Examples will be described with reference to FIGS. 6 to 8.

FIG. 6 is a graph showing a change in conveying amount (developer layer thickness) with respect to the printable number of sheets. FIG. 7 is a graph showing a change in charging amount with respect to the printable number of sheets. FIG. 8 is a table showing the evaluation results of Examples.

An endurance test was conducted using the developing device 200 of this embodiment.

The endurance test was conducted on Examples 1 to 9 in which the distance (L) between the magnet portion 231*b* and the regulating member 400 was constant and the conditions of the magnetic force (m1) of the magnet portion 231*b* and the saturation magnetization (m2) of the regulating member 400 were changed.

(Conditions)

The distance L between the magnet portion 231*b* and the regulating member 400: 7 mm The diameter D of the development roller 230: 20 mm The diameter d of the shaft member 231: 6 mm The magnetic force m1 of the magnet portion 231*b:* 30 mT, 60 mT, 90 mT The saturation magnetization m2 of the regulating member 400: 50 emu/g, 100 emu/g, 150 emu/g Printing pattern: 5% print duty, continuous printing The conditions of Examples 1 to 9: See Table 8.

(Contents)

The endurance test was conducted under the above conditions.

The change in conveying amount (layer thickness) of the developer on the development roller was observed.

The change in charging amount in the developer layer formed on the development roller was observed.

As a reference, the test was also conducted using a non-magnetic regulating member (20 N/m).

Examples 1 to 9 were evaluated as ○ or X based on the change in conveying amount (layer thickness) of the developer and the change in charging amount. For the determination reference of ○ or X in the experiment results, when Examples 1 to 9 were evaluated as ○ when the conveying amount satisfied 0.4 to 0.6 mg/cm$^2$, and as ○ when the charging amount satisfied 15 to 25 μC/g.

(Experiment Results)

The change in conveying amount (layer thickness) with respect to the printable number of sheets: See FIG. 6.

The change in charging amount with respect to the printable number of sheets: See FIG. 7.

The evaluation results of Examples: See FIG. 8.

(From the Experiment Results)

From the graph shown in FIG. 6, as magnetic force m1 and saturation magnetization m2 were smaller, the conveying amount was increased with the increase of the printable number of sheets, whereas as magnetic force m1 and saturation magnetization m2 were larger, the conveying amount was flat and stable even with the increase of the printable number of sheets.

In other words, as the biasing index (biasing force) was smaller, the conveying amount was increased with the increase of the printable number of sheets, whereas as the biasing index (biasing force) was larger, the conveying amount was flat and stable even with the increase of the printable number of sheets.

This was because when the regulating member 400 became worn, as the biasing index (biasing force) was larger, the regulating member 400 was strongly abutted onto the developer layer (development roller), whereas as the biasing index (biasing force) was smaller, the regulating member 400 was weakly abutted onto the developer layer (development roller).

However, when the biasing index (biasing force) was larger than the predetermined value, the conveying amount was reduced.

To maintain the conveying amount stable, the biasing index (biasing force) was required to be in the predetermined range.

Figure 7:
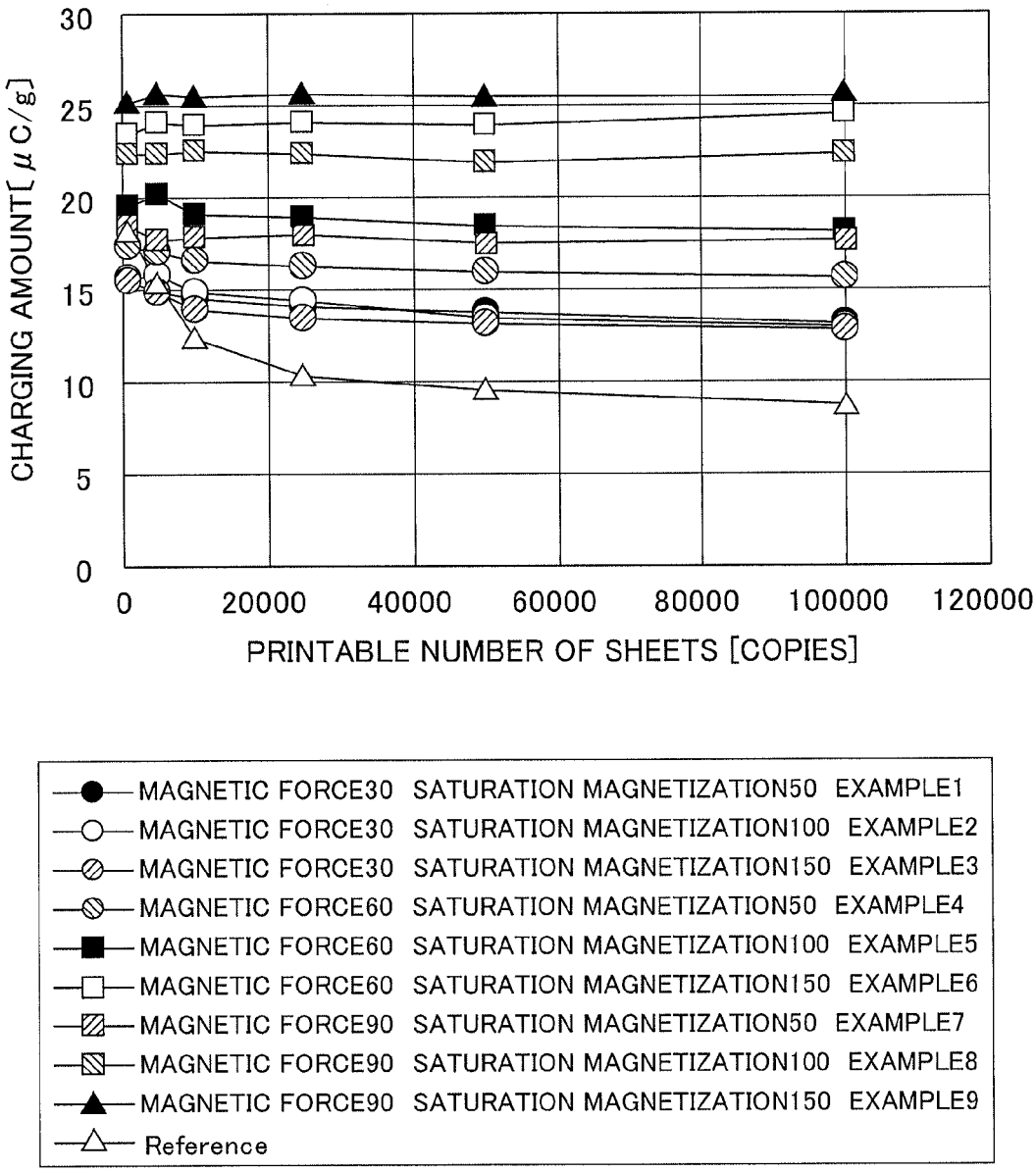
FIG. 7 is a graph showing a change in charging amount with respect to the printable number of sheets.

From the graph shown in FIG. 7, as magnetic force m1 and saturation magnetization m2 were smaller, the charging amount was lower, and the charging amount was lowered with the increase of the printable number of sheets. As magnetic force m1 and saturation magnetization m2 were larger, the charging amount was higher, and the charging amount was flat and stable even with the increase of the printable number of sheets.

In other words, as the biasing index (biasing force) was smaller, the charging amount was lower, and the charging amount was lowered with the increase of the printable number of sheets, whereas as the biasing index (biasing force) was larger, the charging amount was higher, and the charging amount was flat and stable even with the increase of the printable number of sheets.

This was because when the regulating member 400 became worn, as the biasing index (biasing force) was larger, the regulating member 400 was strongly abutted onto the developer layer (development roller), whereas as the biasing index (biasing force) was smaller, the regulating member 400 was weakly abutted onto the developer layer (development roller).

To maintain the conveying amount stable, the biasing index (biasing force) was required to be in the predetermined range.

From the table shown in FIG. 8, Examples 5 to 8 were evaluated as ○.

When the biasing index calculated by (m1×m2)/L$^2$ based on the magnetic force (m1) of the magnet portion 231*b*, the saturation magnetization (m2) of the regulating member 400, and the distance (L) between the magnet portion 231*b* and the regulating member 400 was 90 to 200, Examples 5 to 8 were evaluated as ○.

From Examples 5 to 8, the magnetic force (m1) of the magnet portion 231*b* was particularly preferably 60 [mT] or more.

The preferable embodiment of this disclosure has been described above, but this disclosure can be embodied in various forms without being limited to the above embodiment.

For instance, although in this embodiment, the magnet portion is a cylindrical member and is arranged on the outer circumferential side of the shaft member, the magnet portion is not limited thereto. The entire shaft member 231 may be made of a magnet material, and the shaft member itself may be configured as the magnet portion.

In addition, although in this embodiment, one magnet portion is provided, the magnet portion is not limited thereto, and a plurality of magnet portions may be provided. In this case, the magnet portions may be e.g., a plurality of cylindrical magnet portions arranged at predetermined intervals in the rotational axis direction in the shaft member (rotational shaft member). For instance, the cylindrical magnet portions may be fitted into the shaft member at predetermined intervals.

In this case, the developing device can equally allocate the magnetic force in the rotational axis direction of the development roller 230, and can reduce the cost.

Further, although in this embodiment, the regulating member 400 is a flat plate member, the regulating member 400 is not limited thereto and may be a bent plate member.

Furthermore, although in this embodiment, the printer 1 has been described as the image forming apparatus, the image forming apparatus is not limited thereto and may be a copying machine, a facsimile, or a multi-function peripheral combining these.

The invention claimed is:

1. A developing device supplying a non-magnetic one-component developer onto an image bearing member on which an electrostatic latent image is formed, comprising:

an accommodating portion accommodating the developer;

a supply roller holding the developer accommodated in the accommodating portion on the outer circumferential surface thereof;

a development roller supplying the developer onto the image bearing member; the development roller having a roller portion receiving the developer supplied from the supply roller and holding a developer layer on the outer circumferential surface thereof, and a rotational shaft member arranged to extend along a rotational axis and having at least one magnet portion; and a plate-shaped regulating member arranged to be surface contacted onto the surface of the developer layer on the development roller and having at least part thereof configured of a magnetic member, wherein a magnetic force (m1) of the at least one magnet portion is 60 [mT] or more, and wherein the magnetic force (m1) of the at least one magnet portion of the rotational shaft member, a saturation magnetization (m2) of the regulating member, and a distance (L) between the magnet portion and the regulating member are configured to satisfy a range of 90 to 200 of a biasing index which is calculated by a formula: $(m1 \times m2)/L^2$.

2. The developing device according to claim 1, wherein the regulating member is biased to the rotational shaft member by the magnetic force of the at least one magnet portion of the rotational shaft member and is surface contacted onto the developer layer at a regulation pressure having a predetermined strength.

3. The developing device according to claim 1, wherein the regulating member is a metal plate member.

4. The developing device according to claim 1, wherein the regulating member has one edge which is fixed and the other edge which is a free edge, and is surface contacted onto the developer layer in a predetermined position on the free edge.

5. The developing device according to claim 4, wherein in the regulating member, the free edge is flexible to move to the side spaced from the development roller.

6. The developing device according to claim 4, wherein in the regulating member, an end of the free edge is folded to the opposite side of the development roller.

7. The developing device according to claim 1, wherein the at least one magnet portion includes a plurality of magnet portions, and the magnet portions are arranged at predetermined intervals in the rotational axis direction in the rotational shaft member.

8. An image forming apparatus comprising:

an image bearing member on which an electrostatic latent image is formed; and the developing device according to claim 1.

* * * * *